US007587166B2

(12) United States Patent
Aono

(10) Patent No.: US 7,587,166 B2
(45) Date of Patent: Sep. 8, 2009

(54) FEEDER FOR FEEDING AND RE-FEEDING AN IMAGE FORMING APPARATUS

(75) Inventor: Yoshihiro Aono, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 443 days.

(21) Appl. No.: 11/109,664

(22) Filed: Apr. 20, 2005

(65) Prior Publication Data

US 2005/0238398 A1 Oct. 27, 2005

(30) Foreign Application Priority Data

Apr. 26, 2004 (JP) ..... 2004-129423
Feb. 16, 2005 (JP) ..... 2005-039411

(51) Int. Cl.
*G03G 15/00* (2006.01)

(52) U.S. Cl. ..... 399/401; 399/388; 399/392; 399/391; 271/186; 271/225; 271/184; 271/185

(58) Field of Classification Search ..... 399/388, 399/401, 392, 393; 400/188; 271/186, 185, 271/117, 225, 291, 65, 301
See application file for complete search history.

(56) References Cited

U.S. PATENT DOCUMENTS 4,487,506 A * 12/1984 Repp et al. ..... 399/401
4,692,020 A * 9/1987 Tsujihara ..... 399/401
4,806,979 A * 2/1989 Tokoro et al. ..... 399/401
5,166,738 A * 11/1992 Tani ..... 399/402
5,392,092 A * 2/1995 Laidlaw et al. ..... 355/24
6,215,970 B1 * 4/2001 Yoshikawa et al. ..... 399/124
6,341,777 B1 * 1/2002 Carter ..... 271/291
6,522,860 B2 * 2/2003 Nose et al. ..... 399/374
6,526,255 B2 * 2/2003 Itoh et al. ..... 399/401

FOREIGN PATENT DOCUMENTS

JP 2000-309451 11/2000

* cited by examiner

*Primary Examiner*—Leslie J Evanisko
*Assistant Examiner*—Matthew G Marini
(74) *Attorney, Agent, or Firm*—Oblon, Spivak, McClelland, Maier & Neustadt, P.C.

(57) ABSTRACT

A feeder includes a feed unit and a re-feed unit. A feed unit feeds a recording medium (such as a sheet of paper) on a feed tray to a printer engine. A re-feed unit feeds the recording medium having passed through the printer engine again to the printer engine. A roller pair for paper feeding and another roller pair for paper re-feeding share one drive roller. That is, the drive roller and a driven roller constitute the former roller pair, whereas the drive roller and another driven roller constitute the latter roller pair, thereby enabling the downsizing of the feeder.

19 Claims, 10 Drawing Sheets

FEEDER FOR FEEDING AND RE-FEEDING AN IMAGE FORMING APPARATUS

CROSS-REFERENCE TO RELATED APPLICATIONS

The present document incorporates by reference the entire contents of Japanese priority document, 2004-129423 filed in Japan on Apr. 26, 2004 and 2005-039411 filed in Japan on Feb. 16, 2005.

BACKGROUND OF THE INVENTION

1) Field of the Invention

The present invention relates to the downsizing of a feeder, which includes both of a feed unit and a re-feed unit.

2) Description of the Related Art

A conventional image forming apparatus (such as a copying machine and a printer) is provided with a feeder on the side of the apparatus. The feeder includes a feed unit as a manual feed mechanism and a re-feed unit as a paper reversing mechanism. In such a feeder, generally, the re-feed unit is positioned in the upper portion thereof, and the feed unit is positioned below the re-feed unit (for example, see Japanese Patent Application Laid-Open No. 2000-309451).

FIG. 9 is a schematic diagram of a conventional paper feeding device 208 fitted to an apparatus main unit 5.

A paper reversing mechanism 6 includes a reversing path 23, a reversing roller pair 25 which rotates bidirectionally, a paper re-feed path (re-feed path) 24, and a first feed roller pair 28 near the end of the re-feed path 24. When a recording medium (such as a sheet of paper) with a toner image formed on one side thereof is fed to the reversing path 23, transport of the recording medium is suspended at a position where the rear end (i.e. opposite side with respect to the feed direction) of the recording medium is clamped between the reversing roller pair 25. Thereafter, the reversing roller pair 25 is reversely rotated, to send off the recording medium from the reversing path 23. The recording medium is carried through the re-feed path 24, and re-fed to the printer engine 2 which forms a toner image on the other side of the recording medium. When the printer engine 2 does not form the toner image on the other side, the recording medium is only turned out and ejected onto a paper ejection tray (not shown).

A manual feed mechanism 7 includes a manual feed tray 32, a manual paper feed path (feed path) 33, and a paper feed roller pair (second feed roller pair) 36. The recording medium on the manual feed tray 32 is carried through the manual paper feed path 33 to the paper feed roller pair 36, which is rotated to feed the recording medium to the printer engine 2 in the apparatus main unit 5.

Recently, with the downsizing of the apparatus main unit 5, the paper reversing mechanism 6 and the manual feed mechanism 7 are desired to be as close as possible to each other to downsize the paper feeding device 208. However, there is a limitation on the arrangement of the mechanisms 6 and 7 because the first feed roller pair 28 in the paper reversing mechanism 6 and the paper feed roller pair 36 in the manual feed mechanism 7 should not contact to each other. Therefore, it is difficult to reduce the size of the paper feeding device 208 further than that described in Japanese Patent Application Laid-Open No. 2000-309451.

The size of the paper feeding device 208 can be reduced by removing either one of the first feed roller pair 28 and the paper feed roller pair 36. However, this approach deteriorates the feeding performance of the recording medium, causing a problem that the recording medium is not stably fed to the printer engine 2. There is another problem that the feedable size of the recording medium is restricted. That is, for example, if the first feed roller pair 28 in the paper reversing mechanism 6 is removed, a recording medium having a length shorter than the interval between a carrier roller pair 27 and the resist roller pair 11 cannot be carried in the paper reversing mechanism 6.

Alternatively, the size of the paper feeding device 208 can be reduced by providing, as shown in FIG. 10, a common roller pair 328 which functions as both the first feed roller pair 28 and the paper feed roller pair 36. However, the angle of the re-feed path 24 toward the common roller pair 328 is quite different from the angle of the manual paper feed path 33 toward the common roller pair 328. As a result, if the nip direction of the common roller pair 328 is adjusted for the recording medium fed from the re-feed path 24, the nip direction is not appropriate for the recording medium fed from the manual paper feed path 33, unstabilizing the transport of the recording medium from the manual paper feed path 33. Similarly, if the nip direction is adjusted for the recording medium fed from the manual paper feed path 33, the nip direction is not appropriate for the recording medium fed from the re-feed path 24, unstabilizing the transport of the recording medium from the re-feed path 24. It is possible to make the above angles as close as possible, however, this causes another problem that the paper feeding device 208 becomes large, since the re-feed path 24 and the manual paper feed path 33 cannot be bent largely from the standpoint of stable transport.

SUMMARY OF THE INVENTION

It is an object of the present invention to at least solve the problems in the conventional technology.

A feeder according to an aspect of the present invention feeds a recording medium to a printer engine. The feeder includes a feed path through which the recording medium is fed to the printer engine; a re-feed path through which the recording medium once fed to the printer engine is fed again to the printer engine; and a first roller that is arranged near an end of the feed path and an end of the re-feed path; a second roller that is arranged near the end of the feed path; and a third roller that is arranged near the end of the re-feed path. The first roller and the second roller form a first roller pair for feeding the recording medium from the feed path to the printer engine. The first roller and the third roller form a second roller pair for re-feeding the recording medium from the re-feed path to the printer engine.

An image forming apparatus according to another aspect of the present invention includes a printer engine; a feeder that feeds a recording medium to the printer engine and includes a feed path through which the recording medium is fed to the printer engine; a re-feed path through which the recording medium once fed to the printer engine is fed again to the printer engine; and a first roller that is arranged near an end of the feed path and an end of the re-feed path; a second roller that is arranged near the end of the feed path; and a third roller that is arranged near the end of the re-feed path; and a carrier path that connects the feed path and the re-feed path to the printer engine. The first roller and the second roller form a first roller pair for feeding the recording medium from the feed path to the carrier path. The first roller and the third roller form a second roller pair for re-feeding the recording medium from the re-feed path to the carrier path.

The other objects, features, and advantages of the present invention are specifically set forth in or will become apparent from the following detailed description of the invention when read in conjunction with the accompanying drawings.

DETAILED DESCRIPTION

Exemplary embodiments of the present invention will be explained below with reference to the accompanying drawings.

Figure 1:
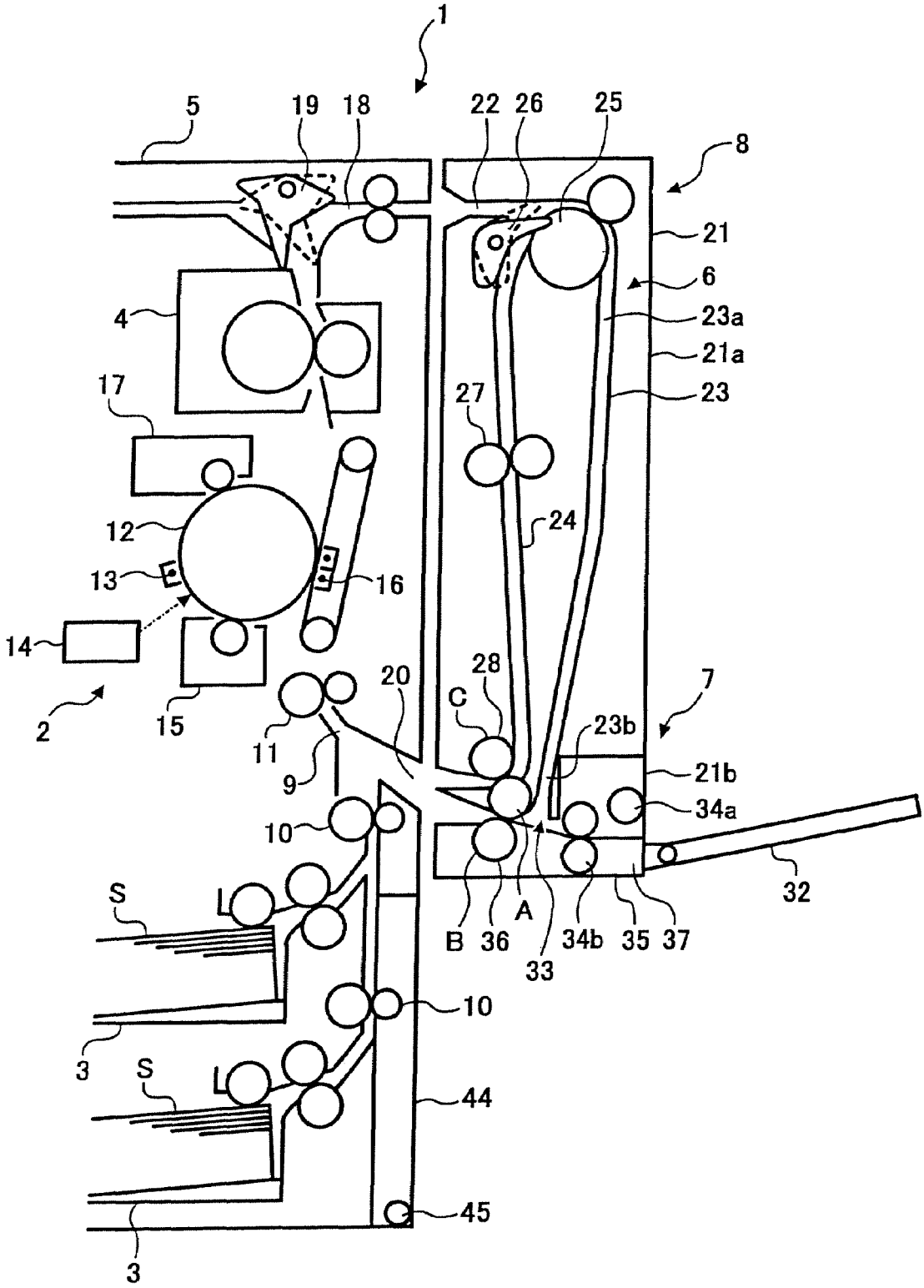
FIG. 1 is a cross-section view of a copying machine according to a first embodiment of the present invention.
Figure 2:
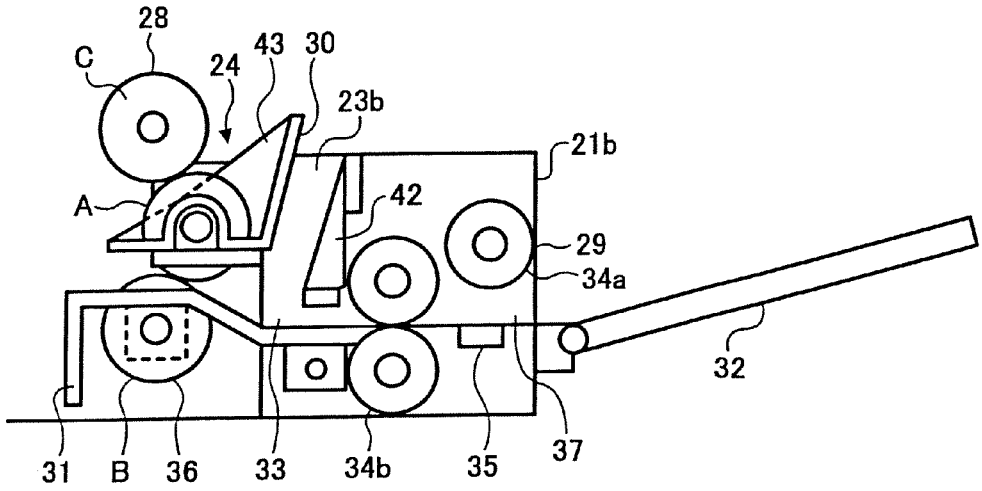
FIG. 2 is a cross-section view of a manual feed mechanism of the copying machine.
Figure 3:
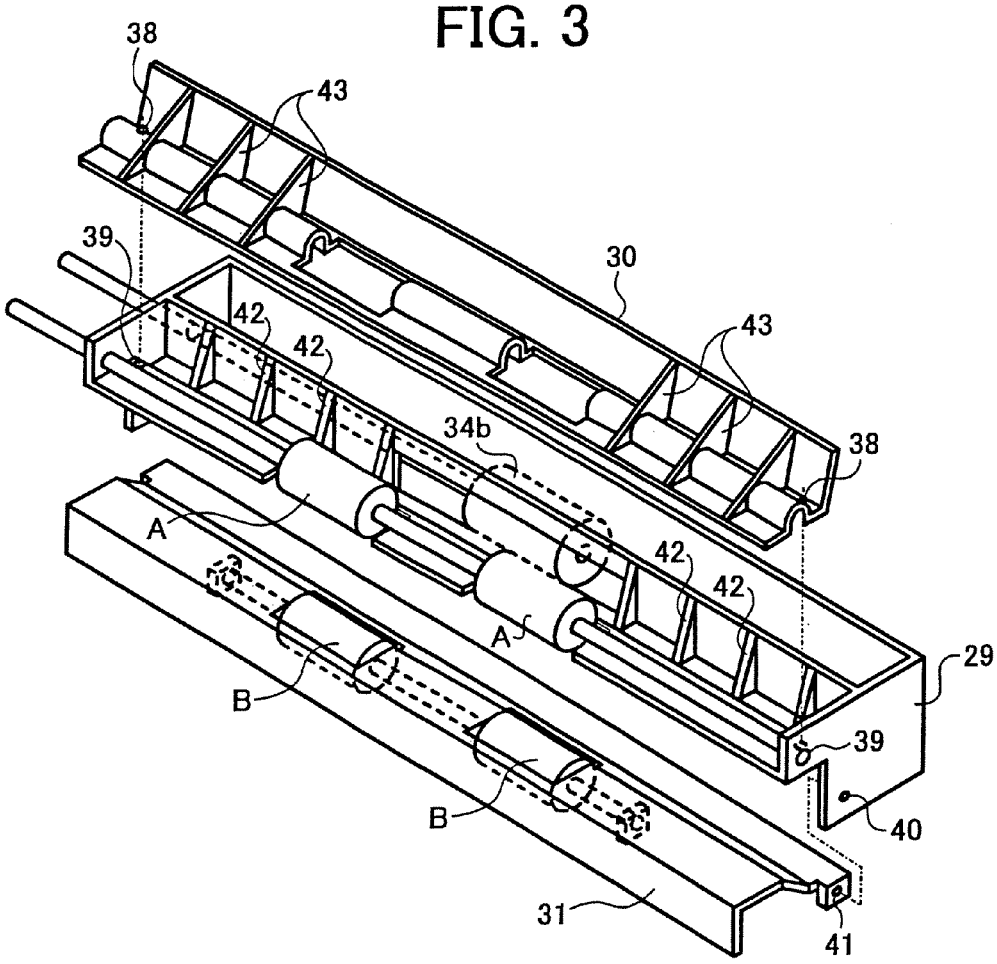
FIG. 3 is an exploded perspective view of the manual feed mechanism.

FIG. 1 is a longitudinally sectioned front view of an internal structure of a copying machine, which is an electrographic image forming apparatus according to a first embodiment, FIG. 2 is a longitudinally sectioned front view of a manual feed mechanism in an enlarged scale, and FIG. 3 is an exploded perspective view of a part of the manual mechanism.

In a copying machine 1 according to this embodiment, a printer engine (image forming unit) 2, a plurality of paper feed cassettes 3 forming other feeders, a fixing unit 4, and the like are provided in an apparatus main unit 5, and a paper feeding device 8 as a feeder, having a paper reversing mechanism 6 as a re-feed unit, and a manual feed mechanism 7 as a feed unit, is fitted to the side of the apparatus main unit 5.

A carrier path 9 through which a recording medium S fed from the paper feed cassette 3 is carried toward a paper ejection tray (not shown) is formed in the apparatus main unit 5, and a carrier roller pair 10, a resist roller pair 11, the printer engine 2, the fixing unit 4, and the like are arranged along the carrier path 9.

The printer engine 2 includes a drum-like photoconductor 12, and a charger 13, an exposure device 14, a developing device 15, a transfer device 16, and a cleaning device 17 arranged around the photoconductor 12.

At the time of image formation by the copying machine 1, the surface of the photoconductor 12 is uniformly charged by the charger 13, light (for example, a laser beam) corresponding to image data read by a scanner (not shown) is emitted by the exposure device 14, and since the light exposes the surface of the photoconductor 12, an electrostatic latent image is formed on the surface of the photoconductor 12. A toner supplied from the developing device 15 is adheres to the electrostatic latent image, thereby manifesting the electrostatic latent image as a toner image. The manifested toner image is transferred onto the recording medium S carried on the carrier path 9 by the transfer action of the transfer device 16. The recording medium S onto which the toner image is transferred is carried on the carrier path 9, fed to the fixing unit 4, and heated and pressurized by the fixing unit 4, and as a result, the toner image is fixed on the recording medium S. The recording medium S on which the toner image is fixed is ejected onto the paper ejection tray (not shown). The toner remaining on the photoconductor 12 after the transfer of the toner image is cleaned by the cleaning device 17.

A reversing paper ejection path 18 is branched from the carrier path 9 at a position on the downstream side of the fixing unit 4 along the transport direction of the recording medium S, and a switching claw 19 for switching the transport direction of the recording medium S to the paper ejection tray side or the reversing paper ejection path 18 side is provided at the branching position. A common feed path 20, to which the reversed recording medium S or the manually fed recording medium S is fed, is formed halfway of the carrier path 9 and on the upstream side of the printer engine 2 along the transport direction of the recording medium S.

The paper feeding device 8 will be explained next.

The paper feeding device 8 includes a case 21 fitted to the side of the apparatus main unit 5, a paper reversing mechanism 6 arranged in the case 21, and a manual feed mechanism 7. The case 21 is formed of an upper case 21*a* and a lower case 21*b* connected to the lower side of the upper case 21*a*.

The paper reversing mechanism 6 includes an entrance path 22, a reversing path 23, and the re-feed path 24 which is a re-feed path, formed in the case 21. The reversing path 23 includes an upper reversing path 23*a* formed in the upper case 21*a* and a lower reversing path 23*b* formed in the lower case 21*b*. One end of the entrance path 22 communicates to the reversing paper ejection path 18, and the other end of the entrance path 22 is connected to the upper reversing path 23*a*. One end of the re-feed path 24 is connected to the entrance path 22 and the other end of the re-feed path 24 communicates to the common feed path 20. A reversing roller pair 25 is reciprocally rotatably provided at the joint of the entrance path 22 and the upper reversing path 23*a*. When the reversing roller pair 25 is rotated in the normal rotation direction (clockwise direction), the recording medium S fed from the reversing paper ejection path 18 to the entrance path 22 is fed to the reversing path 23. The reversing roller pair 25 rotates in the opposite direction (counterclockwise direction) after having fed the recording medium S to the reversing path 23 to a position where the rear end of the recording medium S in the feed direction is clamped by the reversing roller pair 25. Due to this rotation in the opposite direction, the recording medium S once fed to the reversing path 23 is sent out from the reversing path 23. At this time, since a switching claw 26 is switched to the position indicated by a virtual line, the recording medium S sent out from the reversing path 23 is fed to the re-feed path 24. A carrier roller pair 27 is provided halfway of the re-feed path 24, and a first feed roller pair 28 is provided at a position near the upstream side in the feed direction with respect to the end on the downstream side of the re-feed path 24 in the feed direction.

The manual feed mechanism 7 includes, as shown in FIG. 2, the lower case 21*b* formed by connecting a housing 29, a first guide plate 30, and a second guide plate 31, a manual feed tray 32 as a feed tray, a manual paper feed path 33 as a feed path, a pickup roller 34*a*, a separation roller pair 34*b* including a feed roller and a reverse roller, a pad 35, a second feed roller pair 36, the lower reversing path 23*b* and the like. The pickup roller 34*a* is formed so as to be able to come in contact with or be away from the pad 35. The manual feed tray 32 is provided rotatably about a fulcrum 37 between an opening position indicated by solid line in FIG. 1 and a closing position indicated by virtual line in FIG. 1. The recording medium S to be manually fed is placed on the manual feed tray 32. When the pickup roller 34*a* is rotated after the recording medium S has been placed on the manual feed tray 32, the recording medium S on the manual feed tray 32 is transferred to the separation roller pair 34*b*. Thereafter, the recording medium S is separated one by one by the separation roller pair 34*b* and carried on the manual paper feed path 33 and fed from the common feed path 20 to the carrier path 9.

The first guide plate 30 is screwed to the housing 29. This screwing is performed by screwing a screw (not shown) inserted into a round hole 38 formed in the first guide plate 30 into a screw hole 39 formed in the housing 29. The second guide plate 31 is screwed to the housing 29, and this screwing is performed by screwing a screw (not shown) inserted into a round hole 40 formed in the housing 29 into a screw hole 41 formed in the second guide plate 31. The separation roller pair 34*b* and a drive roller A of the second feed roller pair 36 are rotatably held by the housing 29, and a driven roller B of the second feed roller pair 36 is rotatably held by the second guide plate 31.

The lower reversing path 23*b* is formed between the housing 29 and the first guide plate 30 screwed to the housing 29 in a direction crossing the manual paper feed path 33, and the lower reversing path 23*b* communicates to the upper reversing path 23*a* to form the reversing path 23. The width of the lower reversing path 23*b* and the upper reversing path 23*a* (a width in the direction orthogonal to the page) are formed in the same width, so that the end in the feed direction of the recording medium S fed to the upper reversing path 23*a* can be allowed to enter into the lower reversing path 23*b*. The reversing path 23 formed by connecting the upper reversing path 23*a* and the lower reversing path 23*b* crosses the manual paper feed path 33 in an inverted T shape. The lower end of the reversing path 23 (the part of the lower reversing path 23*b*) is positioned on the downstream side of the separation roller pair 34*b* along the transport direction of the recording medium S in the manual paper feed path 33. A plurality of ribs 42 is formed along the width direction of the lower reversing path 23*b* (a direction orthogonal to the page), at positions facing the lower reversing path 23*b* in the housing 29.

A plurality of ribs 43 arranged in the same direction as the array direction of the ribs 42 is formed on the first guide plate 30, and these ribs 43 form a part of the inner circumference of the end on the other side of the re-feed path 24. The first feed roller pair 28 is positioned near the part where the ribs 43 are formed, and the first feed roller pair 28 is formed of a drive roller A and a driven roller C. The drive roller A is also used as a drive roller A of the second feed roller pair 36. The driven roller C in the first feed roller pair 28 is rotatably held by the upper case 21*a*. A drive motor that can be flexibly switched to the normal rotation or the opposite rotation is connected to the roller A. When the recording medium S is fed from the manual feed tray 32, the roller A is rotated in the normal rotation direction (clockwise direction), and when the recording medium S is re-fed from the re-feed path 24, the roller A is rotated in the opposite direction (counterclockwise direction).

The end (the end on the downstream side in the feed direction) of the re-feed path 24 and the end (the end on the downstream side in the feed direction) of the manual paper feed path 33 are opened close to each other, and are connected to the common feed path 20 formed in the apparatus main unit 5.

As shown in FIG. 1, an opening/closing cover 44 that opens the carrier path 9 for handling a paper jam when the recording medium S carried from the paper feed cassette 3 provided in the apparatus main unit 5 toward the printer engine 2 causes a jam in the carrier path 9, is fitted so as to be opened or closed about a spindle 45 as a fulcrum, on the side of the apparatus main unit 5 and below the paper feeding device 8.

The configuration and the operation of the first feed roller pair 28, the second feed roller pair 36, and the separation roller pair 34*b*, which are the characteristic parts of the present invention, will be explained next.

Figure 4A:
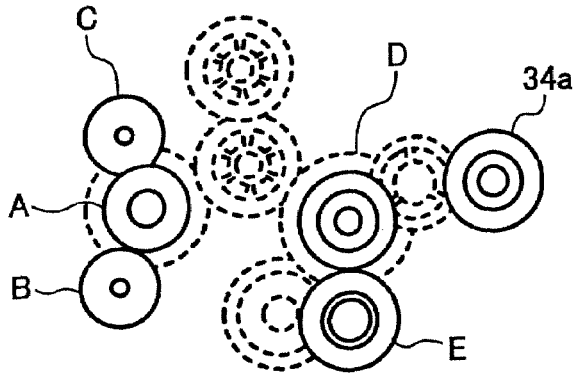
FIG. 4A is a diagram for explaining an arrangement of rollers.
Figure 4B:
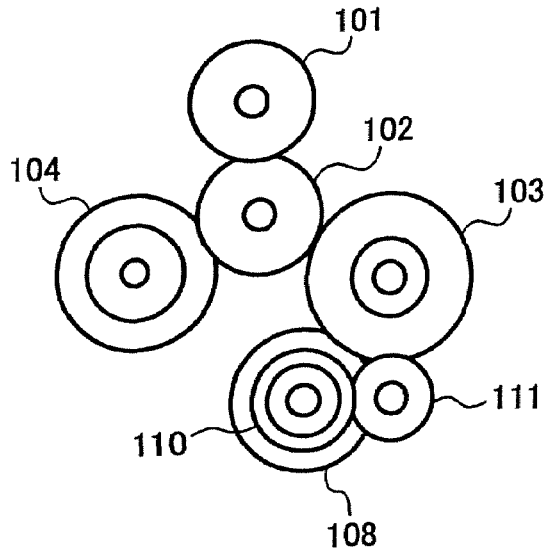
FIG. 4B is a diagram for explaining an arrangement of gears.
Figure 4C:
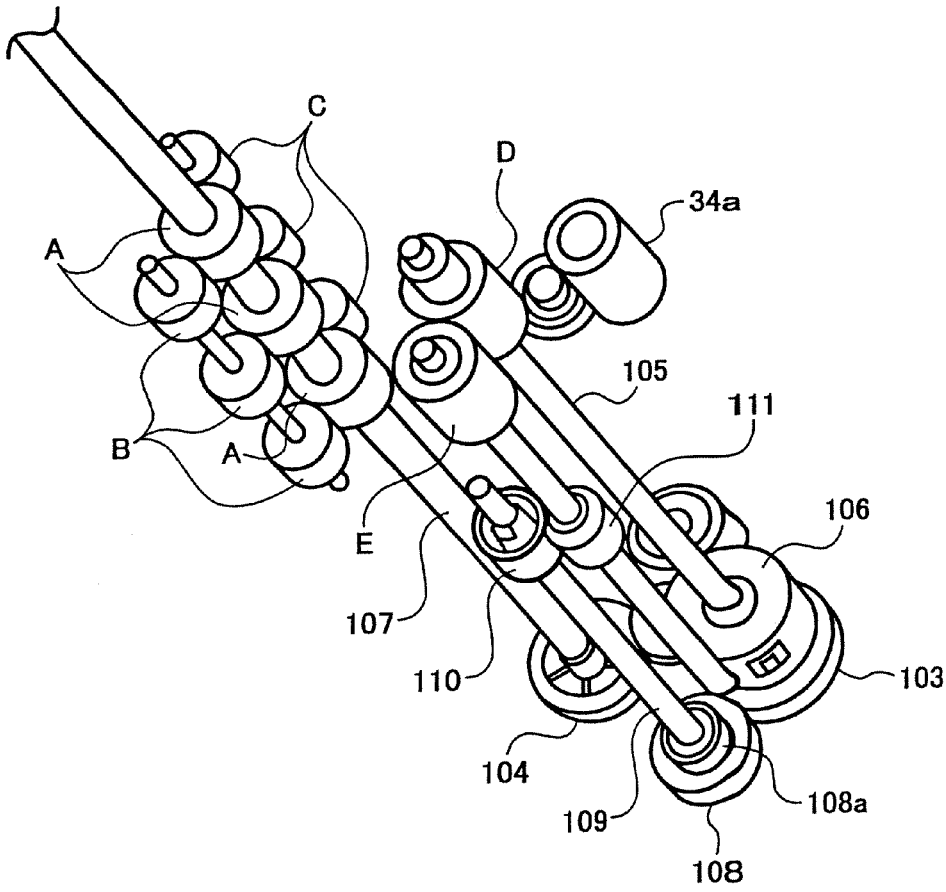
FIG. 4C is a perspective view of the rollers and the gears.

FIG. 4A is a diagram for explaining an arrangement of rollers constituting the first feed roller pair 28, the second feed roller pair 36, and the separation roller pair 34*b*. FIG. 4B is a diagram for explaining an arrangement of gears for transmitting a driving force to the above rollers. FIG. 4C is a perspective view of the drive rollers and the gears.

Rollers A, D, and E constituting the roller pairs 28, 36, and 34*b* and the pickup roller 34*a* are driven by a rotation driving force from the same drive source (not shown). The drive source generates a rotation driving force in a direction designated by a control signal from a controller (not shown), to rotate the rollers in the normal direction or in the opposite direction.

A first idler gear 101 rotates due to the driving force from the drive source, and the rotation driving force is transmitted to a second idler gear 102, which engages with the first idler gear 101 as shown in FIG. 4B. The second idler gear 102 also engages with a feed clutch gear 103 and a drive roller gear 104.

The feed clutch gear 103 constitutes an electromagnetic clutch 106 connected to a feed shaft 105 of a feed roller D. The electromagnetic clutch 106 enables or blocks transmission of a driving force between the feed clutch gear 103 and the feed shaft 105, according to a control signal from a controller (not shown). When the feed clutch gear 103 is connected to the feed shaft 105, the rotation driving force transmitted from the second idler gear 102 to the feed clutch gear 103 is further transmitted to the feed shaft 105, to rotate the feed roller D which constitutes the separation roller pair 34*b*.

On the other hand, the rotation driving force transmitted from the second idler gear 102 to the drive roller gear 104 is transmitted to a drive roller shaft 107 of the common roller A, thereby rotating the common roller A which constitutes the first feed roller pair 28 and the second feed roller pair 36 (in other words, the first feed roller pair 28 and the second feed roller pair 36 share the common roller A).

The feed clutch gear 103 also engages with a reverse input gear 108. The reverse input gear 108 includes a one-way clutch 108*a* in the bearing portion thereof, and is connected to a reverse driving shaft 109 via the one-way clutch 108*a*. The rotation driving force in the normal direction, which is transmitted from the feed clutch gear 103 to the reverse input gear 108, is further transmitted to the reverse driving shaft 109 via the one-way clutch 108*a* (On the other hand, the rotation driving force in the opposite direction is not transmitted to the reverse driving shaft 109, only to rotate the reverse input gear 108 in vain). The rotation driving force transmitted to the reverse driving shaft 109 is further transmitted to a reverse drive gear 110 and a reverse driven gear 111 fixed to a reverse driven shaft 112, to rotate a reverse roller E, which constitutes the separation roller pair 34*b*.

Figure 5A:
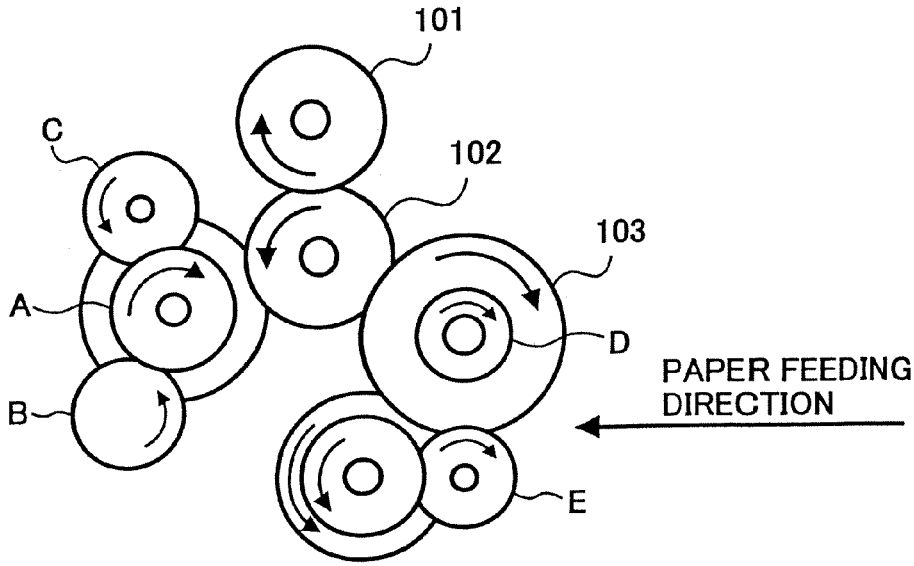
FIG. 5A is a diagram for explaining the rotation direction of the rollers and the gears when paper is fed from the manual feed mechanism.
Figure 5B:
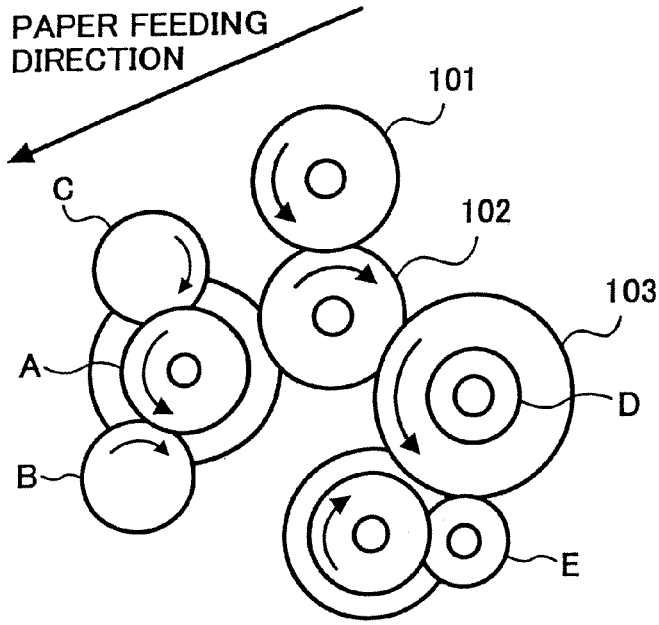
FIG. 5B is a diagram for explaining the rotation direction of the rollers and the gears when paper is re-fed from a paper reversing mechanism.

FIG. 5A is a diagram for explaining the rotation direction of each part shown in FIGS. 4A to 4C when the recording medium S is fed from the manual feed tray 32 to the carrier path 9. FIG. 5B is a diagram for explaining the rotation direction of each part shown in FIGS. 4A to 4C when the recording medium S is fed from the re-feed path 24 to the carrier path 9.

(1) Operation at the Time of Manual Feed

For feeding the recording medium S on the manual feed tray 32 to the carrier path 9, the drive source generates a rotation driving force in the normal direction, thereby rotating the first idler gear 101, the second idler gear 102, and the feed clutch gear 103 in a direction shown in FIG. 5A. The rotation driving force is transmitted to the pickup roller 34*a* via the feed shaft 105 since the electromagnetic clutch 106 is turned ON.

When the pickup roller 34*a* starts to rotate, one sheet (or a plurality of sheets) which is placed on the manual feed tray 32 and abutted against the pickup roller 34*a* is delivered to the separation roller pair 34*b* (that is, a pair of the feed roller D and the reverse roller E). The feed roller D rotates in a direction shown in FIG. 5A, by the rotation driving force transmitted from the first idler gear 101 via the second idler gear 102, the feed clutch gear 103, the electromagnetic clutch 106, and the feed shaft 105, to send the recording medium S to the printer engine 2. On the other hand, the reverse roller E rotates in a direction shown in FIG. 5A, by the rotation driving force transmitted from the first idler gear 101 via the second idler gear 102, the feed clutch gear 103, the reverse input gear 108, the reverse driving shaft 109, the reverse drive gear 110, and the reverse driven gear 111, to send the recording medium S back to the manual feed tray 32. Even when a plurality of sheets is fed from the pickup roller 34*a* to the separation roller pair 34*b*, the sheets other than the first one are returned to the manual feed tray 32 by the reverse roller E. The load applied to the reverse roller E increases extremely when the separation roller pair 34*b* clamps only one sheet, which causing a torque limiter (not shown) provided on the reverse driven shaft 112 to allow the reverse roller E to rotate along with the feed roller D. Thus, the recording medium S is sent to the second feed roller pair 36 (that is, a pair of the common roller A and the driven roller B) one by one.

The common roller A rotates in a direction shown in FIG. 5A, by the rotation driving force transmitted from the first idler gear 101 via the second idler gear 102, the drive roller gear 104, and the drive roller shaft 107. The driven rollers B and C rotate along with the common roller A. Thus, the recording medium S is carried from the manual feed tray 32 to the common feed path 20 and the carrier path 9 via the separation roller pair 34*b* and the second feed roller pair 36. The printer engine 2 transfers a toner image to one side of the recording medium S, which is fixed by the fixing unit 4. Thereafter, the recording medium S is directly ejected to the paper ejection tray, or sent to the paper reversing mechanism 6 as explained later when an image is to be formed on the other face or when the recording medium S is to be reversed and ejected to the paper ejection tray without any image on the other side.

(2) Operation at the Time of Re-Feed

For feeding the recording medium S from the paper reversing mechanism 6 to the carrier path 9, the drive source generates a rotation driving force in the opposite direction, thereby rotating the first idler gear 101, the second idler gear 102, and the feed clutch gear 103 in a direction shown in FIG. 5B. However, the rotation driving force is not transmitted to the feed shaft 105 since the electromagnetic clutch 106 is turned OFF. Therefore, the pickup roller 34*a* and the feed roller D do not rotate. On the other hand, the rotation driving force is transmitted from the feed clutch gear 103 to the reverse input gear 108, but is not transmitted to the reverse driving shaft 109 due to the one-way clutch 108*a*. Therefore, the reverse roller E does not rotate.

If the one-way clutch 108*a* is not provided, the rotation driving force in the opposite direction generated by the drive source is transmitted to the reverse driving shaft 109, to rotate the reverse roller E. The feed roller D can rotate along with the reverse roller E since the electromagnetic clutch 106 is turned OFF. As a result, the recording medium S erroneously fed from the manual feed tray 32 and the recording medium S fed from the paper reversing mechanism 6 cause a jam in the common feed path 20, the carrier path 9, or the printer engine 2. In this embodiment, however, the one-way clutch 108*a* prevents such a trouble.

On the other hand, the common roller A rotates in a direction shown in FIG. 5B, by the rotation driving force transmitted from the first idler gear 101 via the second idler gear 102, the drive roller gear 104, and the drive roller shaft 107. Accordingly, the recording medium S is fed to the common feed path 20 and the carrier path 9. The printer engine 2 transfers a toner image onto the recording medium S, which is fixed by the fixing unit 4, or passes through the recording medium S without transferring the toner image. Thereafter, the recording medium S is ejected to the paper ejection tray.

The common roller A is a drive roller in this embodiment, however, the common roller A can be a driven roller while any one of the rollers B and C being a drive roller.

When the both rollers B and C are the drive roller, for example, the respective drive rollers are connected to the drive source via a mechanism such as the electromagnetic clutch, which can intercept the transmission of the driving force. The roller B rotates at the time of the manual feed with the roller C following the rotation. The roller C rotates at the time of re-feed with the roller B following the rotation.

When either one of the rollers B or C is a drive roller, the drive roller can be directly connected to the drive source. For example, when the roller B is the drive roller, the roller B rotates to carry the recording medium S in the manual paper feed path 33 to the common feed path 20 at the time of manual feed from the manual feed mechanism 7. On the other hand, at the time of re-feed from the paper reversing mechanism 6, the roller B rotates in the opposite direction. Accordingly, the roller A rotates along with the roller B to feed the recording medium in the re-feed path 24 to the common feed path 20. The roller C rotates along with the roller A. The same thing applies when the roller C is the drive roller.

In this embodiment, the paper feeding device 8 includes the paper reversing mechanism 6 together with the manual feed mechanism 7. However, the manual feed mechanism 7 can be replaced by such a feed unit that feeds the recording medium in the paper feed cassette.

In such a configuration, an instance in which an image is formed on the both sides of the recording medium S by the copying machine 1 will be explained in detail.

The recording medium S fed from the paper feed cassette 3 or the manual feed tray 32 is carried in the carrier path 9, and a toner image is transferred to one side of the recording medium S in the printer engine 2 and is fixed in the fixing unit 4. Since the fixing processing is performed in the fixing unit 4, the recording medium S, on one side of which the toner image is formed, is sent to the reversing paper ejection path 18 side by the switching claw 19, which is switched to a position shown by solid line in FIG. 1, and fed into the reversing path 23 via the reversing paper ejection path 18 and the entrance path 22. At the timing when the rear end in the feed direction of the recording medium S fed to the reversing path 23 is clamped by the reversing roller pair 25, the rotation of the reversing roller pair 25 is suspended, and then, the reversing roller pair 25 is rotated in the opposite direction. Due to this rotation in the opposite direction, the recording medium S fed into the reversing path 23 is sent out from the reversing path 23. At this time, the switching claw 26 is switched to a position of feeding the recording medium S fed from the reversing path 23 to the re-feed path 24 (a position shown by virtual line in FIG. 1), and the recording medium S is fed into the re-feed path 24.

The recording medium S fed to the re-feed path 24 is carried by the carrier roller pair 27 and the first feed roller pair 28, and fed in a reversed state from the common feed path 20 to the carrier path 9. After the recording medium S is carried through the carrier path 9, a toner image is transferred to the other face of the recording medium S in the printer engine 2. When the second transfer of the toner image to the recording medium S is carried out, the switching claw 19 has already been switched to the position shown by virtual line in FIG. 1, and the recording medium S to which the second transfer of the toner image has been carried out is sent to the paper ejection tray side, after the toner image is fixed thereon by the fixing unit 4, and then ejected onto the paper ejection tray.

According to the paper feeding device 8 in this embodiment, the reversing path 23 formed of the upper reversing path 23*a* and the lower reversing path 23*b* is extended to the position where the reversing path 23 crosses the manual paper feed path 33 in an inverted T shape, and hence, a member for partitioning between the reversing path 23 and the manual paper feed path 33 is not necessary, thereby enabling downsizing of the paper feeding device 8. Further, since the reversing path 23 formed of the upper reversing path 23*a* and the lower reversing path 23*b* is extended to the position where the reversing path 23 crosses the manual paper feed path 33 in the inverted T shape, even when the paper feeding device 8 is made small and the size thereof in the vertical direction is decreased, the length of the reversing path 23 can be kept long. Accordingly, even when the copying machine 1 and the paper feeding device 8 are made small, a recording medium S having a long size can be reversed in the reversing path 23, and hence, image formation on both sides of the recording medium S having a long size can be performed favorably.

Since the lower end portion of the reversing path 23 (the portion of the lower reversing path 23*b*) is positioned on the downstream side of the separation roller pair 34*b* along the transport direction of the recording medium S in the manual paper feed path 33, the reversing path 23 can be formed without having any limitation due to the separation roller pair 34*b*. Further, the recording medium S fed into the reversing path 23 can be fed to the lower end of the lower reversing path 23*b* without having any limitation due to the recording medium S placed on the manual feed tray 32, and the entire length of the reversing path 23 can be effectively used for reversing the recording medium S.

According to the paper feeding device 8, the end of the re-feed path 24 and the end of the manual paper feed path 33 are opened close to each other, and connected to the common feed path 20 formed in the apparatus main unit 5. Therefore, the gap between the end of the re-feed path 24 and the end of the manual paper feed path 33 decreases, thereby realizing downsizing of the paper feeding device 8 more effectively. Further, since the first feed roller pair 28 provided at the end of the re-feed path 24 and the second feed roller pair 36 provided at the end of the manual paper feed path 33 shares one roller A, downsizing of the paper feeding device 8 and reduction of the number of parts can be realized. Since the common roller A is a drive roller, the number of parts in the drive system can be reduced, thereby further contributing to making the paper feeding device 8 small.

By realizing the downsizing of the paper feeding device 8, the fitting position of the paper feeding device 8 to the apparatus main unit 5 can be shifted upward. Accordingly, the size of the opening/closing cover 44 can be increased, and a jam occurring at a lower position in the carrier path 9 of the apparatus main unit 5 can be easily handled.

When the fitting position of the paper feeding device 8 to the apparatus main unit 5 is shifted upward due to the downsizing of the paper feeding device 8, there is a problem in that the recording medium S manually fed from the manual feed mechanism 7 cannot be carried by the carrier roller pair 10 in the apparatus main unit 5. However, since the manually fed recording medium S can be fed to the carrier path 9 by the second feed roller pair 36, even for a recording medium S having a short length, a carrying power for carrying the recording medium S in the carrier path 9 can be ensured, thereby enabling smooth manual feed.

Figure 6:
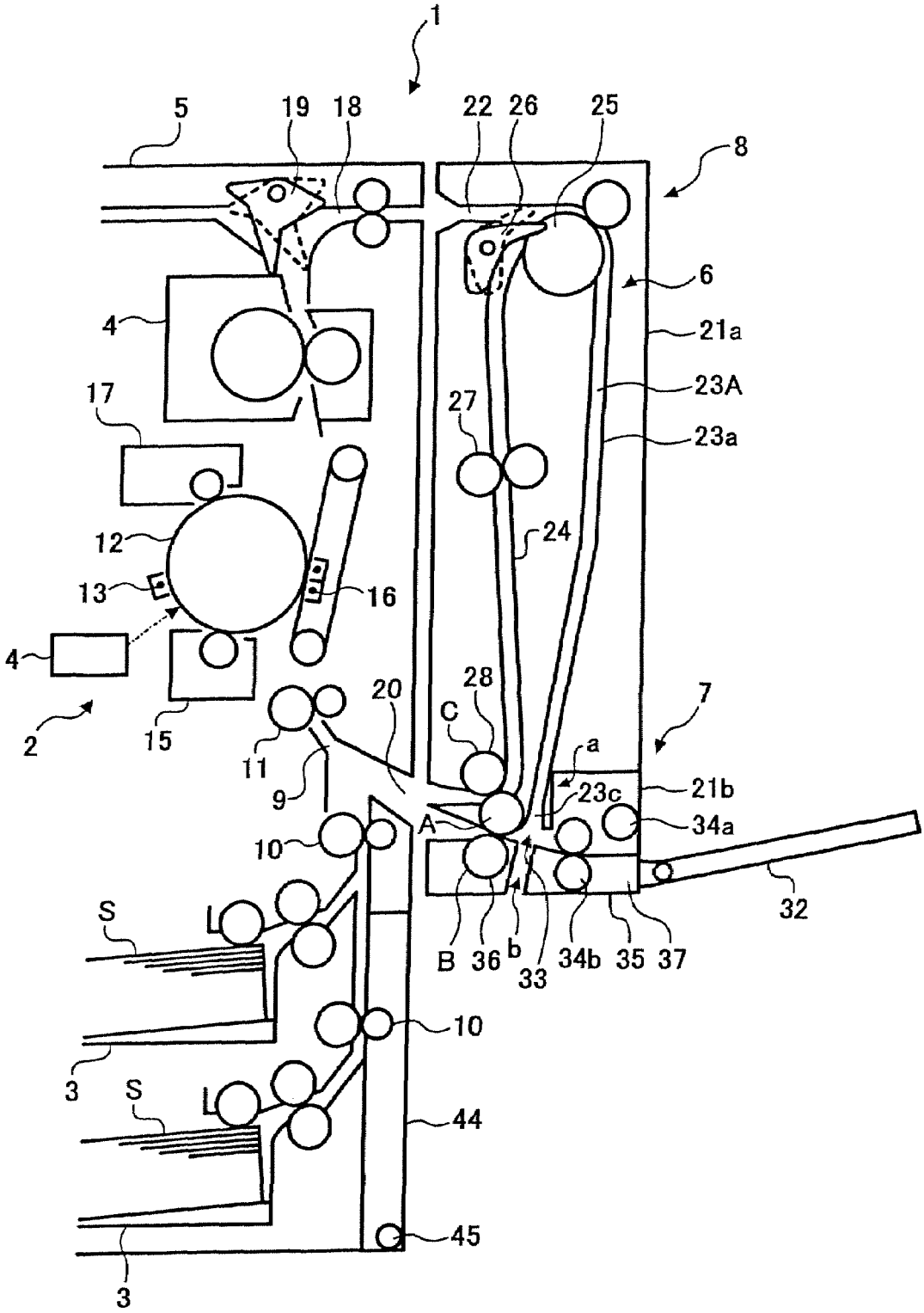
FIG. 6 is a cross-section view of a copying machine according to a second embodiment of the present invention.

A first example of the above embodiment (hereinafter, "example 1") will be explained with reference to FIG. 6. Like reference sign denote like parts as explained in FIGS. 1 to 3, and the explanation thereof is omitted (the same thing applies to other examples).

The basic structure of the example 1 is the same as the above embodiment, and the difference between the example 1 and the embodiment is that a reversing path 23A in the example 1 is formed longer than the reversing path 23 in the embodiment, so that a longer recording medium S can be also reversed.

The reversing path 23A is formed of an upper reversing path 23*a* formed in the upper case 21*a* and a lower reversing path 23*c* formed in the lower case 21*b*. The lower reversing path 23*c* is formed of a gap portion "a" provided between the housing 29 and the first guide plate 30 screwed to the housing 29, and an opening "b" formed in the second guide plate 31 positioned below the gap portion "a". The lower reversing path 23*c* and the upper reversing path 23*a* constitute the reversing path 23A, and the reversing path 23A and the manual paper feed path 33 cross each other in a cruciform shape. The widths (the width in a direction orthogonal to the page) of the lower reversing path 23*c* and the upper reversing path 23*a* are formed in the same size, so that the end in the feed direction of the recording medium S fed into the upper reversing path 23*a* can be allowed to enter into the lower reversing path 23*c*. The lower end of the lower reversing path 23*c* is opened.

In such a configuration, when the length of the recording medium S fed in the reversing path 23A is long, the lower end of the recording medium S can be extended from the lower end of the reversing path 23A (the opening "b"), so as to enable reversing processing using the reversing path 23A with respect to various types of recording medium S having a large length.

Figure 7:
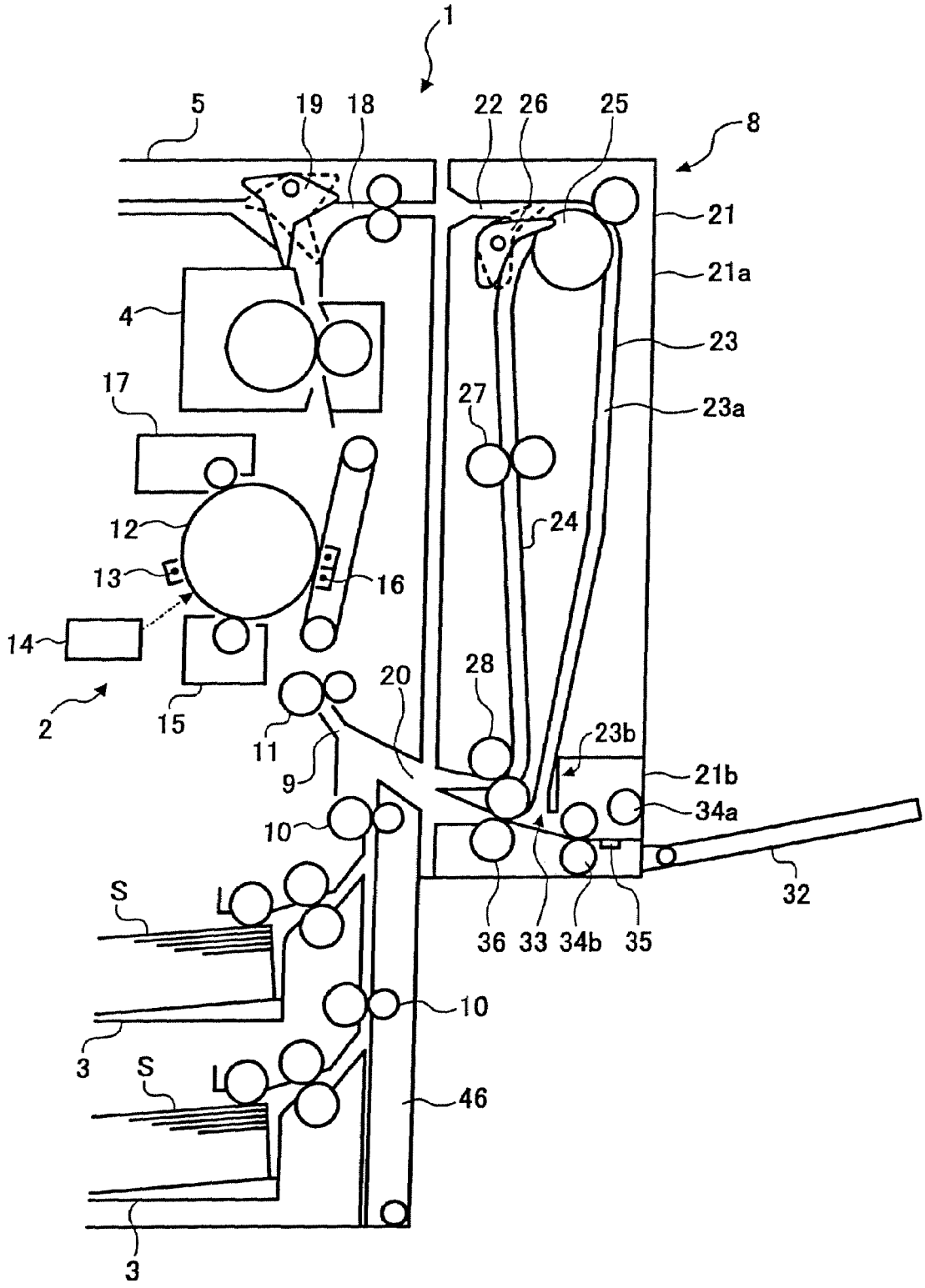
FIG. 7 is a cross-section view of a copying machine according to a third embodiment of the present invention.

A second example of the above embodiment (hereinafter, "example 2") will be explained with reference to FIGS. 7 and 8. The basic structure of the example 2 is the same as the above embodiment, and the difference between the example 2 and the embodiment is the structure of an opening/closing cover 46 provided in the lower part of the apparatus main unit 5 and below the paper feeding device 8 in the example 2, and that the paper feeding device 8 is connected to the opening/closing cover 46. The opening/closing cover 46 is fitted so as to be able to open the carrier path 9 for handling a jam occurring in the lower part of the carrier path 9 in the apparatus main unit 5. The opening/closing cover 46 is fitted to the apparatus main unit 5 so as to rotate around the spindle 45 along with the horizontal direction, with the upper end being directed downward, to open the carrier path 9.

Figure 8:
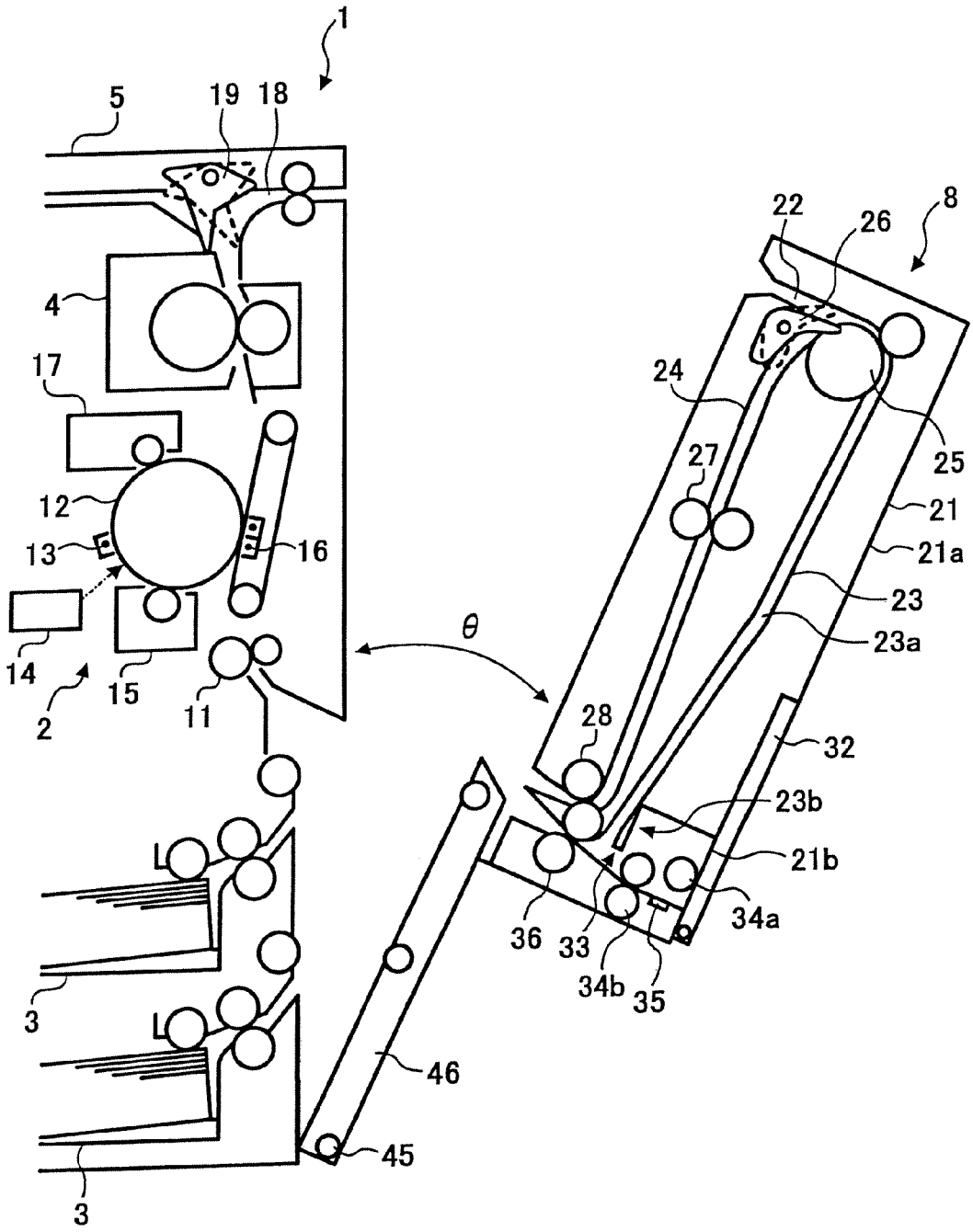
FIG. 8 is a cross-section view of the copying machine according to the third embodiment when an opening/closing cover is opened.
Figure 9:
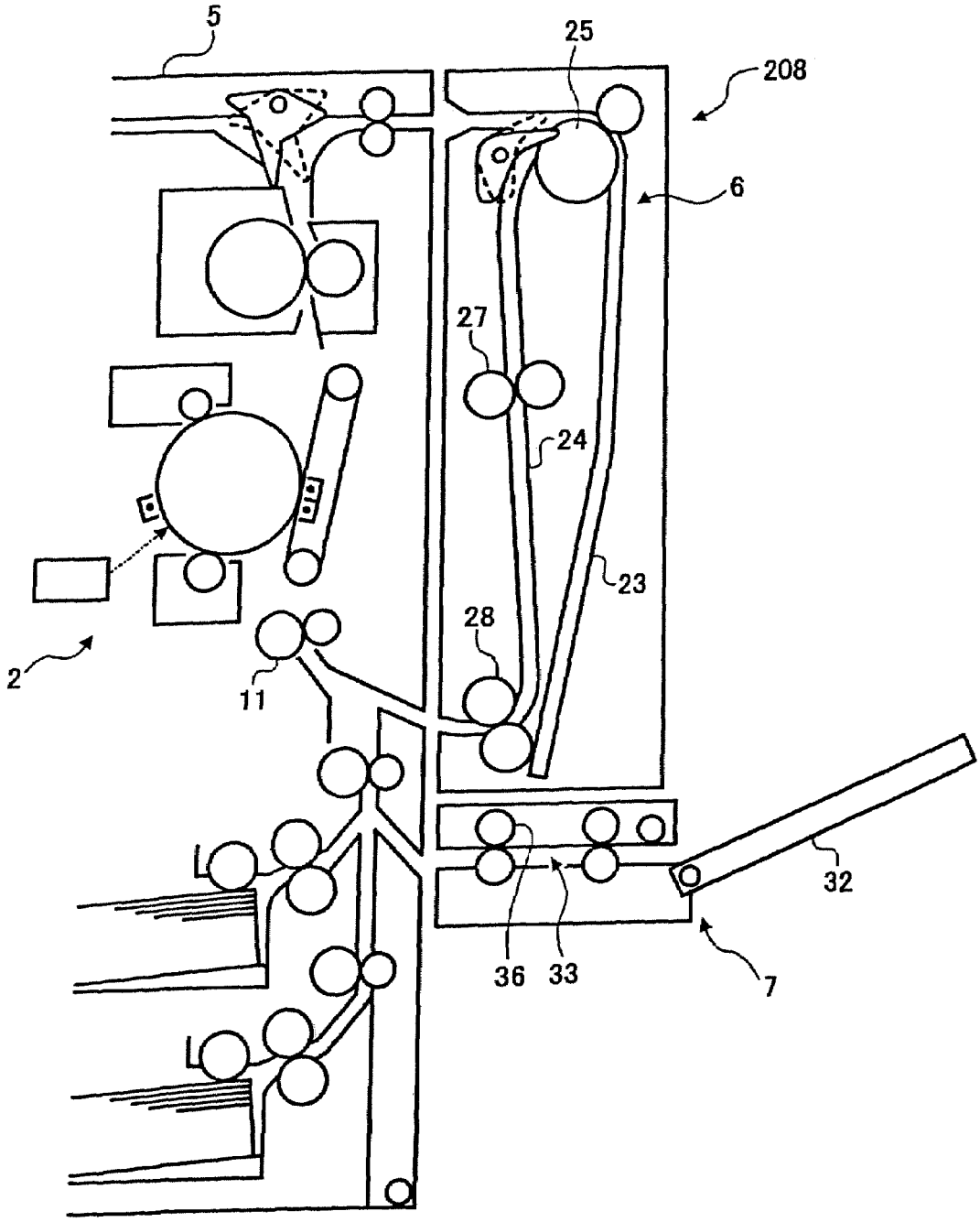
BACKGROUND ART FIG. 9
FIG. 9 is a cross-section view of a conventional paper feeding device.
Figure 10:
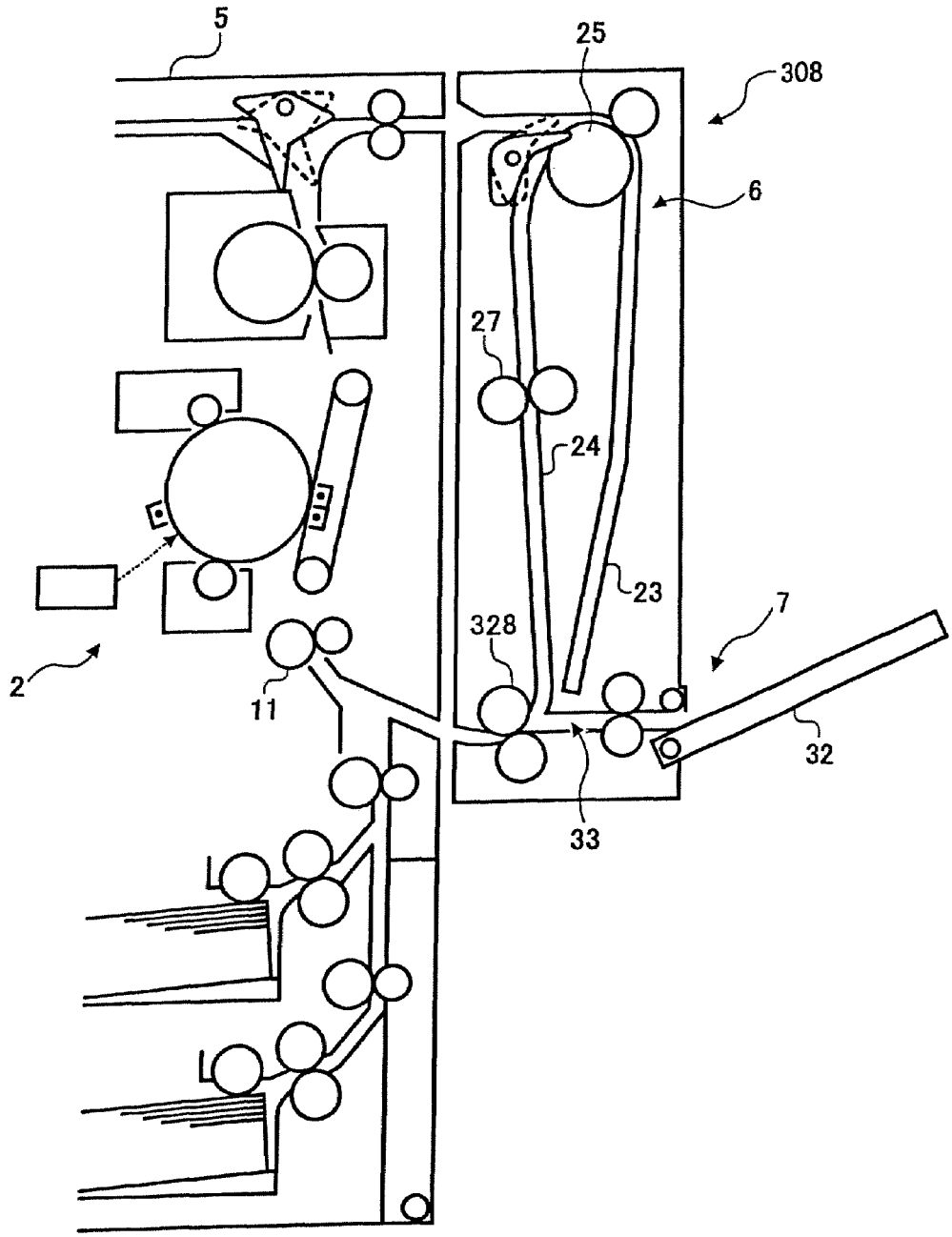
BACKGROUND ART FIG. 10
FIG. 10 is a cross-section view of another conventional paper feeding device.

In such a configuration, when the opening/closing cover 46 is opened for handling a jam having occurred in the lower part of the carrier path 9, the paper feeding device 8 rotates together with the opening/closing cover 46, as shown in FIG. 8. At this time, in the example 2, since the paper feeding device 8 is made small and the vertical size thereof is reduced, the paper feeding device 8 connected to the opening/closing cover 46 can be positioned in an upper position. Therefore, when the opening/closing cover 46 is rotated to the opening position together with the paper feeding device 8, the paper feeding device 8 hardly touches the floor or the like, and hence, the opening angle "θ" of the opening/closing cover 46 can be increased. Accordingly, a jam having occurred in the lower part of the carrier path 9 in the apparatus main unit 5 can be easily handled.

The copying machine as an image forming apparatus in the embodiment includes the apparatus main unit 5 in which the printer engine 2 is housed therein and the carrier path 9 for carrying the recording medium S to the printer engine 2 is provided therein, and a feed unit that feeds the recording medium S to the carrier path 9. The paper feeding device 8 is used as the feed unit, and the end on the downstream side in the feed direction of the re-feed path 24 and the end on the downstream side in the feed direction of the manual paper feed path 33 are made to communicate to the carrier path 9 in the apparatus main unit 5. The paper feeding device 8 includes the paper reversing mechanism 6 as the re-feed unit having the re-feed path 24, which is a re-feed path for feeding the recording medium S after having passed through the printer engine 2 again to the printer engine 2, and the first feed roller pair 28 provided close to the upstream side in the feed direction of the re-feed path 24 with respect to the end on the downstream side in the feed direction thereof, and the manual feed mechanism 7 having the manual paper feed path 33 as a feed path for carrying the recording medium S on the manual feed tray 32, which is a feed tray, toward the printer engine 2, and the second feed roller pair 36 provided close to the upstream side in the feed direction of the manual paper feed path 33 with respect to the end on the downstream side in the feed direction thereof. The end on the downstream side in the feed direction of the re-feed path 24 and the end on the downstream side in the feed direction of the manual paper feed path 33 are arranged close to each other, and one roller constituting the first feed roller pair 28 and another roller constituting the second feed roller pair 36 are formed of the common roller A. Accordingly, the paper reversing mechanism 6 and the manual feed mechanism 7 can be arranged close to each other, as compared to the conventional copying machine. Further, such problems can be avoided that the carrying performance of the recording medium decreases to make feeding difficult, and that the feedable size of the recording medium is limited, which may occur in the first method. Further, such a case that the leading edge of the recording medium is blocked by the opening portion on the upstream side in the feed direction of the common roller A does not occur, thereby enabling stable feed of the recording medium S both in the paper reversing mechanism 6 and the manual feed mechanism 7.

In the embodiment, since the common roller A is a drive roller that rotates due to a driving force from the drive source, the recording medium S can be fed stably both in the paper reversing mechanism 6 and the manual feed mechanism 7. Particularly in the embodiment, two rollers B and C other than the common roller A are driven rollers that follow the rotation of the common roller A, the number of parts of the drive system can be reduced, thereby further contributing to making the paper feeding device 8 smaller.

In the embodiment, since the manual feed tray 32 is a manual feed tray, the manual feed mechanism 7 can be arranged upward with respect to the apparatus main unit 5. Accordingly, a mechanism for taking out the recording medium S jammed on the upstream side in the feed direction of the carrier path 9 from the paper feed cassette 3 can be easily arranged without being interrupted by the manual feed mechanism 7. Accordingly, handling of the jam can be simplified.

In the embodiment, a cassette feeding device, which is another feeder having the paper feed cassette 3, is provided in addition to the paper feeding device 8 having the manual paper feed path 33 for carrying the recording medium S on the manual feed tray 32 toward the printer engine 2. The end on the downstream side in the feed direction of the feed path in the cassette feeding device communicates to the carrier path 9 at a second position on the downstream side in the transport direction of the recording medium than a first position at which the end on the downstream side in the feed direction of the re-feed path 24 and the end on the downstream side in the feed direction of the manual paper feed path 33 communicate to the carrier path 9, and the opening/closing cover 44 that can open the portion of the carrier path 9 on the downstream side in the transport direction of the recording medium than the first position to the outside of the apparatus main unit 5 is provided. Thus, in the embodiment, since the manual feed mechanism 7 can be arranged upward with respect to the apparatus main unit 5, the opening/closing cover 44 can be provided in this portion. By opening the opening/closing cover 44, the recording medium S jammed in this portion can be easily taken out from the cassette feeding device.

As explained in the example 2, a cassette feeding device, which is another feeder having the paper feed cassette 3, is provided in addition to the paper feeding device 8 having the manual paper feed path 33 for carrying the recording medium S on the manual feed tray 32 toward the printer engine 2. The end on the downstream side in the feed direction of the feed path in the cassette feeding device communicates to the carrier path 9 at a second position on the downstream side in the transport direction of the recording medium than a first position at which the end on the downstream side in the feed direction of the re-feed path 24 and the end on the downstream side in the feed direction of the manual paper feed path 33 communicate to the carrier path 9, and the opening/closing cover 46 that can open the portion of the carrier path 9 including at least the first position and the second position to the outside of the apparatus main unit 5, and is integrally formed with the paper feeding device 8 is provided. Accordingly, when the opening/closing cover 46 is opened together with the paper feeding device 8, the paper feeding device 8 hardly touches the floor or the like, and hence, the opening angle "θ" of the opening/closing cover 46 can be increased. Accordingly, a jam having occurred in the lower part of the carrier path 9 in the apparatus main unit 5 can be easily handled.

According to the present invention, there is an excellent effect that the feeder having the re-feed unit and the feed unit can be made small, without causing problems in the first and the second methods in the conventional technology.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A feeder that feeds a recording medium to a printer engine, comprising:

a feed path through which the recording medium is fed to the printer engine;

a re-feed path through which the recording medium once fed to the printer engine is fed again to the printer engine;

a first roller that is arranged near an end of the feed path and an end of the re-feed path;

a second roller that is arranged near the end of the feed path; and a third roller that is arranged near the end of the re-feed path, wherein the first roller and the second roller form a first roller pair for feeding the recording medium from the feed path to the printer engine, the first roller and the third roller form a second roller pair for re-feeding the recording medium from the re-feed path to the printer engine, and the first roller rotates in a different direction between the first roller pair and the second roller pair.

2. The feeder according to claim 1, wherein the first roller is a drive roller.

3. The feeder according to claim 2, wherein the second roller and the third roller are driven rollers that rotate along with the first roller.

4. The feeder according to claim 1, further comprising a feed tray from which the recording medium is fed to the feed path.

5. The feeder according to claim 1, wherein another end of the re-feed path has an opening that opens the re-feed path to an outside of the feeder whereby a tip of the recording medium can go out of the feeder via the opening.

6. The feeder according to claim 4, wherein the first roller and the second roller are positioned between the feed tray and the printer engine on the feed path.

7. An image forming apparatus, comprising:

a printer engine;

a feeder that feeds a recording medium to the printer engine and includes a feed path through which the recording medium is fed to the printer engine;

a re-feed path through which the recording medium once fed to the printer engine is fed again to the printer engine;

a first roller that is arranged near an end of the feed path and an end of the re-feed path;

a second roller that is arranged near the end of the feed path; and a third roller that is arranged near the end of the re-feed path; and a carrier path that connects the feed path and the re-feed path to the printer engine, wherein the first roller and the second roller form a first roller pair for feeding the recording medium from the feed path to the carrier path, the first roller and the third roller form a second roller pair for re-feeding the recording medium from the re-feed path to the carrier path, and the first roller rotates in a different direction between the first roller pair and the second roller pair.

8. The image forming apparatus according to claim 7, wherein the first roller is a drive roller.

9. The image forming apparatus according to claim 8, wherein the second roller and the third roller are driven rollers that rotate along with the first roller.

10. The image forming apparatus according to claim 7, further comprising a feed tray from which the recording medium is fed to the feed path.

11. The image forming apparatus according to claim 7, wherein another end of the re-feed path has an opening that opens the re-feed path to an outside of the feeder whereby a tip of the recording medium can go out of the feeder via the opening.

12. The image forming apparatus according to claim 7, further comprising:

a second feeder that feeds the recording medium to the printer engine;

a second feed path through which the recording medium in the second feeder is fed to the printer engine, wherein the carrier path connects the feed path and the re-feed path to the carrier path at a first point, and connects the second feed path to the carrier path at a second point that is closer to the printer engine than the first point.

13. The image forming apparatus according to claim 12, further comprising an opening/closing cover that makes the carrier path open to an outside of the feeder at a point closer to the printer engine than the first point.

14. The image forming apparatus according to claim 13, wherein the feeder is configured to be separated from a main body of the image forming apparatus.

15. The image forming apparatus according to claim 14, wherein the feeder, when separated from the main body of the image forming apparatus, is connected to the opening/closing cover.

16. The image forming apparatus according to claim 12, further comprising an opening/closing cover that makes the carrier path open to an outside of the feeder at a point closer to the feeder than the first point.

17. The image forming apparatus according to claim 16, wherein the feeder is configured to be separated from a main body of the image forming apparatus.

18. The image forming apparatus according to claim 17, wherein the feeder, when separated from the main body of the image forming apparatus, is connected to the opening/closing cover.

19. The image forming apparatus according to claim 10, wherein the first roller and the second roller are positioned between the feed tray and the printer engine on the feed path.

* * * * *